US005763825A

United States Patent [19]

Gilliland

[11] Patent Number: 5,763,825

[45] Date of Patent: Jun. 9, 1998

[54] CABLE WITH INTERNAL FERRITE

[75] Inventor: Don Alan Gilliland, Rochester, Minn.

[73] Assignee: International Business Machines Corporation, Armonk, N.Y.

[21] Appl. No.: 636,471

[22] Filed: Apr. 19, 1996

[51] Int. Cl.[6] ..... H01B 11/06

[52] U.S. Cl. ..... 174/36; 333/243

[58] Field of Search ..... 333/243; 174/36, 174/74 R, 74 A, 75 B, 76, 77 R

[56] References Cited

U.S. PATENT DOCUMENTS

| | | | |
|---|---|---|---|
| 2,508,479 | 5/1950 | Wheeler | 333/243 |
| 2,935,805 | 4/1960 | Doherty | 333/243 |
| 3,238,477 | 3/1966 | Brueckmann | 333/243 |
| 3,692,922 | 9/1972 | Sugimoto et al. | 174/73.1 |
| 4,104,600 | 8/1978 | Mayer | 333/79 |
| 4,301,428 | 11/1981 | Mayer | 333/12 |
| 4,383,225 | 5/1983 | Mayer | 333/12 |
| 4,486,721 | 12/1984 | Cornelius et al. | 333/1 |
| 4,506,235 | 3/1985 | Mayer | 333/12 |
| 4,775,849 | 10/1988 | Lucas | 336/90 X |
| 4,816,614 | 3/1989 | Baigrie et al. | 174/36 |
| 5,223,806 | 6/1993 | Curtis et al. | 333/12 |

*Primary Examiner*—Kristine L. Kincaid
*Assistant Examiner*—Chau N. Nguyen
*Attorney, Agent, or Firm*—Felsman, Bradley, Gunter and Dillon

[57] ABSTRACT

An improved electrical signal cable is shown of the type having a plurality of centrally located conductors running along a longitudinal axis of the cable. A shield layer surrounds the plurality of centrally located conductors. A toroid of resistive-inductive material, such as lumped ferrite, is mounted about the plurality of centrally located conductors at one discrete location along the length of the cable by locating the resistive-inductive toroid between the centrally located conductors and the shield layer, common mode emissions are reduced.

12 Claims, 3 Drawing Sheets

CABLE WITH INTERNAL FERRITE

BACKGROUND OF THE INVENTION

1. Technical Field

The present invention relates to electrical signal cables of the type used in digital systems and to devices for reducing common mode emissions from such cables.

2. Description of the Related Art

A large number of commonly encountered digital devices utilize electrical signal cables of the single and multiconductor variety. One common digital system, for example, is the digital computer, particularly the personal computer. These systems typically feature a central station housing or body connected by one or more multiconductor cables to one or more peripheral devices such as printers, modems, external disk drives, CD-ROM devices, and the like.

The standard "shielded" cable used for these purposes features a plurality of centrally located conductors which are surrounded by a, e.g., braided metallic shield layer which, in turn, is surrounded by an outer elastomeric type jacket. In some cases, standard shielded cables of the general type described allow emanation of common mode emissions which cause the digital system involved to fail existing emissions requirements.

The prior art teaches exotic and expensive cable arrangements wherein ferrite shielding is distributed along the length of the cable, with the intended application typically being very high frequencies. See, for example, U.S. Pat. No. 4,486,721, issued Dec. 4, 1984, to Cornelius et al., entitled "High Frequency Attenuation Core and Cable." Cable of the above type, with shielding distributed along the entire length of the cable, is typically relatively expensive to manufacture. Shielding of the type described could not be applied externally as a discrete unit near the computer to an after market computer cable in order to allow the computer manufacturer to meet minimum common mode emission levels required by law in many countries.

The present invention has as its object to provide an improved electrical signal cable, particularly of the multiconductor variety, with reduced common mode emission characteristics.

Another object of the invention is to provide such an improved cable having internal, lumped ferrite shielding which provides higher reflection of common mode emissions at lower relative frequencies, typically less than 100 MHz.

Another object of the invention is to provide a resistive-inductive core element for use on such a cable to reduce common mode emissions which can be installed externally to but near the computer on an after market computer cable to allow a manufacturer to meet minimum common mode emission levels required by law.

Another object of the invention is to provide a resistive-inductive core element and cable of simple design which is economical to manufacture as compared to the devices of the prior art.

SUMMARY OF THE INVENTION

The improved electrical signal cable of the invention has a length and a longitudinal axis. At least one centrally located conductor runs along the longitudinal axis of the cable. A shield layer surrounds the centrally located conductor. A core element of resistive-inductive material having a central opening therein is mounted about the centrally located conductor at one discrete location along the length of the cable. The centrally located conductor passes through the central opening in the core element, whereby the core element is located between the centrally located conductor and the shield layer at the said one discrete location. Preferably, the resistive-inductive material is lumped ferrite.

The improved multiconductor signal cable of the invention has a length and a longitudinal axis and a plurality of centrally located conductors running along the longitudinal axis of the cable. A metallic shield layer surrounds the plurality of centrally located conductors. A lumped ferrite toroid having a central opening therein is mounted about the plurality of centrally located conductors at one discrete location along the length of the cable. The lumped ferrite toroid is mounted about the plurality of centrally located conductors with the centrally located conductors passing through the central opening in the lumped ferrite toroid, whereby the lumped ferrite toroid is located between the centrally located conductors and the metallic shield layer at the said one discrete location. An encapsulating layer surrounds the ferrite toroid beneath the metallic shield layer. Preferably the encapsulating layer is a plastic molding compound. A flexible outer jacket can also be installed about the encapsulating layer and the metallic shield layer.

The present invention also encompasses a resistive-inductive core element for use on a multiconductor signal cable to reduce common mode emissions, the cable having a length and a longitudinal axis and having a plurality of centrally located conductors surrounded by a metallic shield layer. An improved core unit of the invention includes a lumped ferrite toroid having a central opening therein for receiving the plurality of centrally located conductors of the multiconductor signal cable at one discrete location along the length of the cable. An encapsulating layer surrounds the lumped ferrite toroid when the toroid is installed on the centrally located conductors. The lumped ferrite toroid is mountable about the plurality of centrally located conductors with the centrally located conductors passing through the central opening in the lumped ferrite toroid when the cable metallic shield layer is partly removed to leave oppositely exposed shield ends which are spaced apart along the longitudinal axis of the cable. A metallic core shield layer surrounds the encapsulating layer. An electrical joint connects the metallic core shield layer with oppositely exposed shield ends of the cable metallic shield, whereby the lumped ferrite toroid is located between the centrally located conductors and a metallic shield layer at one discrete location along the longitudinal axis of the cable. Preferably, the core metallic shield layer comprises a layer of metal tape which is wound about the encapsulating layer of the lumped ferrite toroid and the electrical joint which connects the metallic core shield layer to the oppositely exposed cable metallic shield ends is comprised of a pair of solder joints joining the cable metallic shield ends and the core metal tape.

The present invention also encompasses a digital system including a central station housing, at least one peripheral device and a cable of the type previously described which interconnects the central station housing and the peripheral device.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
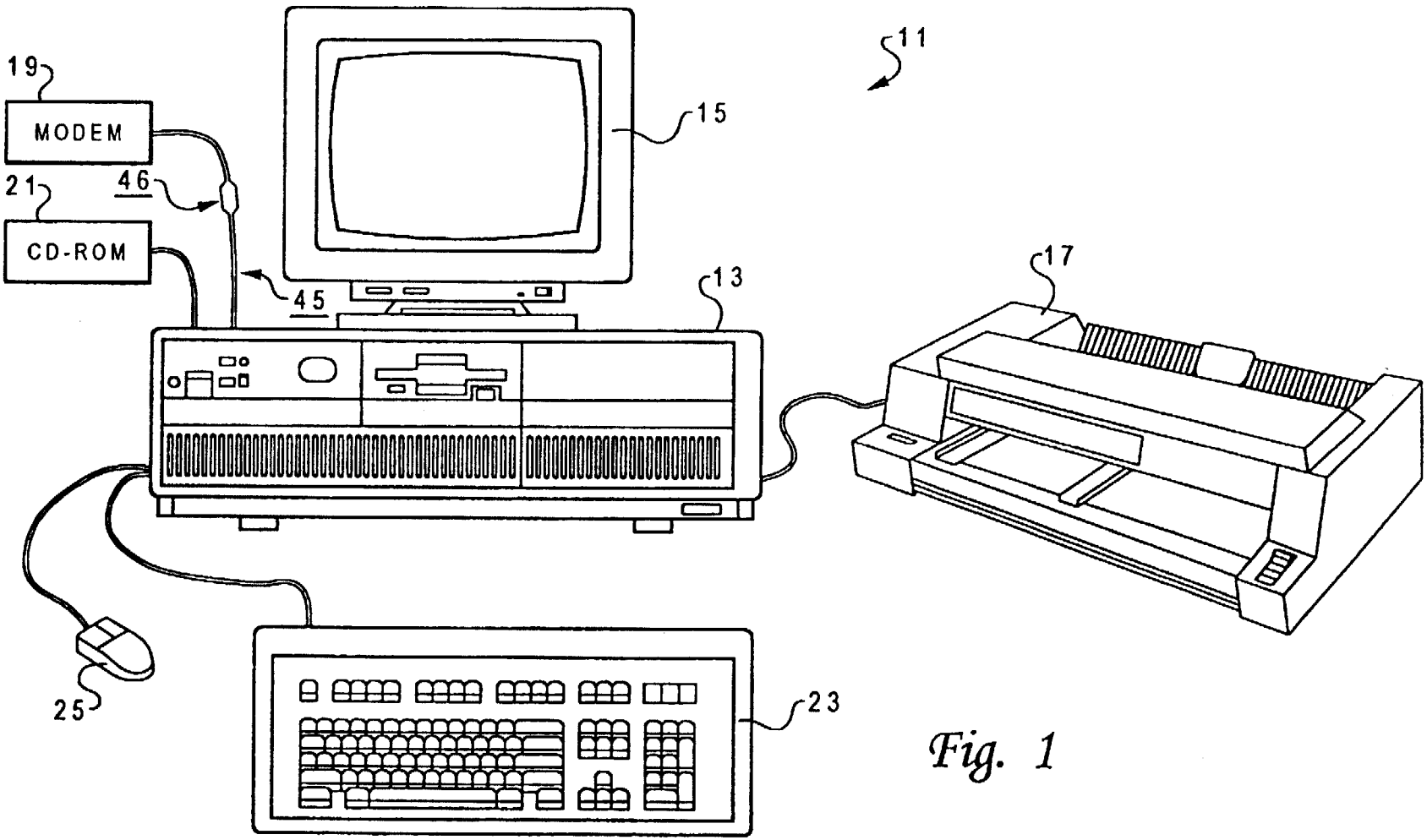
FIG. 1 is perspective view of a digital system, in this case a personal computer system, employing the improved electrical signal cable of the invention to connect a central station housing to a variety of peripheral devices.

FIG. 1 is a view of a typical digital system, in this case a personal computer system, capable of utilizing the improved electrical signal cable of the invention. The digital system 11 in FIG. 1 includes a central station housing 13 which, in this case, is the computer main body containing the principle components of the personal computer such as the microprocessor, power supply, etc. The central station housing 13 is connected to a variety of peripheral devices including the monitor 15, printer 17, modem 19 and CD-ROM 21 (both shown in simplified fashion in FIG. 1). The central station housing 13 is also electrically connected to an external keyboard 23 and pointing device or mouse 25. The improved cable of the invention could be used with any number of peripheral type devices of the kind illustrated where the reduction in common mode emissions is of concern. In the embodiment of FIG. 1, the improved cable of the invention is illustrated as 45.

Figure 2:
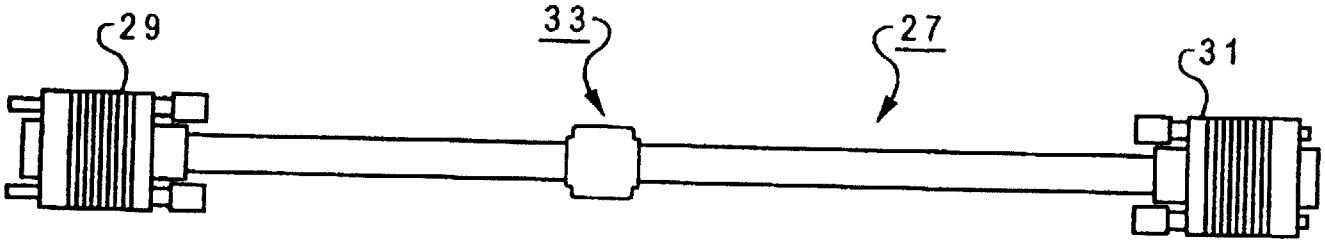
Fig. 2 Prior Art
FIG. 2 is a side, perspective view of an electrical signal cable of the prior art.

FIG. 2 shows a prior art multiconductor cable illustrated generally as 27. The cable 27 has a pair of opposing connector ends 29, 31, one of which is provided with a plurality of pins and the other of which is provided with a plurality of sockets (not shown). Such cables are of standard design and will be well familiar to those skilled in the art.

Figure 2A:
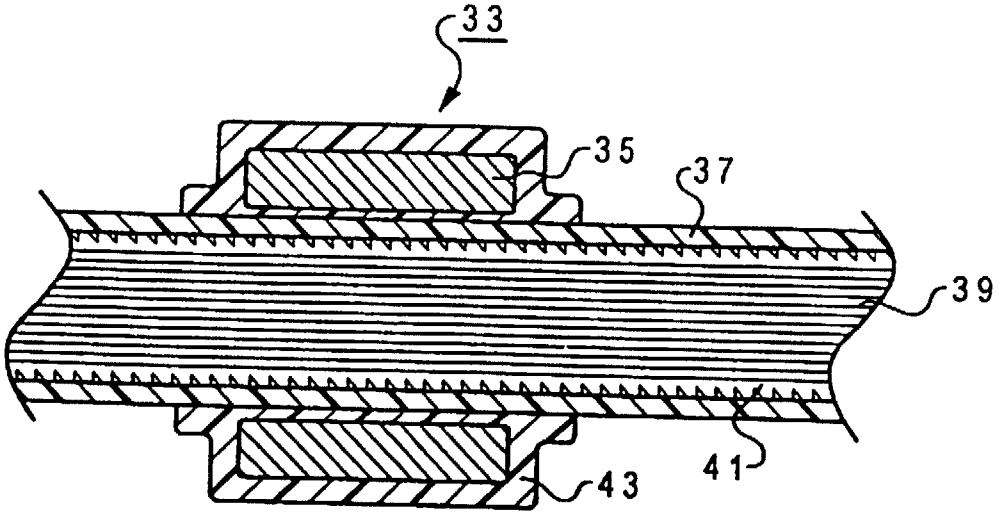
Fig. 2a Prior Art
FIG. 2*a* is partial, cross-sectional view of the prior art cable of FIG. 2.

FIG. 2*a* is a cross-sectional view of the prior art ferrite core design utilized on the outside of the cable 27 in an attempt to reduce common mode emissions, the ferrite core unit being designated generally as 33. As best seen in FIG. 2*a*, the ferrite core 35 is slipped about the exterior of the cable jacket 37 and is separated from the plurality of conductors 39 by the braided shield 41 and outer elastomeric jacket 37. "A layer of shrink tubing 43 was typically installed about the ferrite core 35 after the core was installed about the jacket 37 of the cable 27. " The ferrite core 35 could be provided as an intact toroid and slipped over the exterior of the cable 27 during the manufacturing process of the cable or, if the toroid was provided in halves, it could be installed about the cable exterior as an after market item. While the placement of the ferrite core 35 on the exterior of the cable 27 resulted in a slight reduction in common mode emissions, the effect was minimal at best and failed to address the problem of reducing such emissions to a level that would allow a manufacturer to satisfy current emissions requirements.

Figure 3:
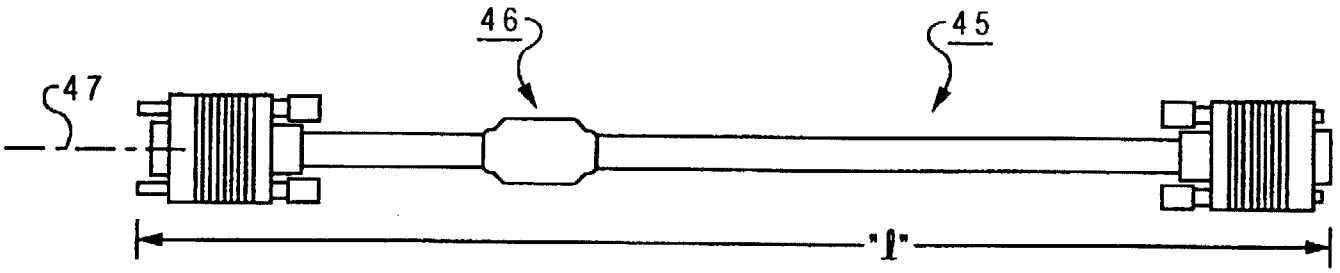
FIG. 3 is a side perspective view of the improved electrical signal cable of the invention.
Figure 3A:
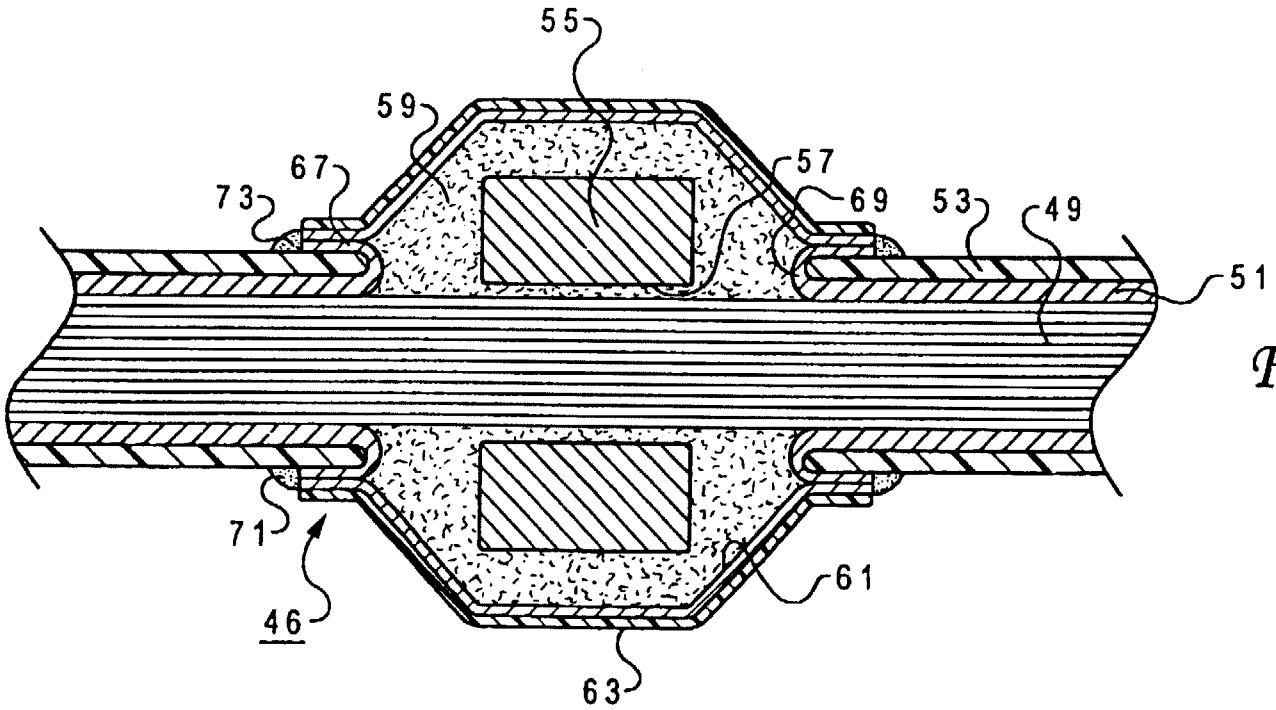
FIG. 3*a* is a partial, cross-sectional view of the cable of FIG. 3 illustrating the improved resistive-inductive core element thereof.

The improved electrical signal cable of the invention is designated generally as 45 in FIG. 3 and includes one or more core unites 46. The electrical signal cable 45 has a length ("T" in FIG. 3) and a longitudinal axis 47. As shown in FIG. 3*a*, the electrical signal cable 45 has at least one, and preferably a plurality of, centrally located conductors 49 which run along the longitudinal axis 47 of the cable 45.

A cable metallic shield layer 51 initially surrounds the centrally located conductors 49. A braided shield is generally preferred, since it is more flexible than a solid metal layer, and copper braid materials are frequently utilized. A metal foil layer could also be utilized, however. A flexible outer jacket 53 of a resilient material such as a rubber or other polymeric material typically surrounds the metallic braid 51.

As shown in FIG. 3*a* each core unit 46 includes, a core element of resistive-inductive material 55 having a central opening 57 therein is mounted about the centrally located conductors 49 at one discrete location along the length "T" of the cable 45 with the centrally located conductors 49 passing through the central opening 57 in the core element 55.

The resistive-inductive material 55 can be any material having the requisite properties for reducing common mode emissions including ferrite, ceramics, zinc, nickel, iron, etc. By "ferrite" is meant any ferromagnetic material having high electrical resistivity which has a spinel crystal structure and the general chemical formula $XF\theta_2O_4$, where X represents a divalent metal ion whose size is such that it will fit into the chemical structure. Ferrites are made by dissolving hydrated ferric oxide in concentrated alkali solution; by fusing ferric oxide with alkali metal chloride, carbonate, or hydroxide; or by simply heating metal oxides with ferric oxide. Ceramic ferrites are made by press forming powdered ingredients (with a binder) into a sheet, then sintering or firing. The preferred material is lumped ferrite, available from any of a number of commercial sources.

As shown in FIG. 3*a*, an encapsulating layer 59 surrounds the ferrite toroid 55. The encapsulating layer can be any encapsulating or potting medium which is compatible with the core 55 and remaining cable components, such as a suitable plastic or epoxy molding compound. In the embodiment shown, the plastic molding compound was "3779 JET MELT" adhesive, provided by 3M Corporation of St. Paul, Minn.

The encapsulating layer 59 is also surrounded by a metallic core shield layer 61 which, in this case, is a copper foil tape available commercially from 3M Corporation which has been wrapped about the exterior of the encapsulating layer 59. In this way, the core element 55 is located between the centrally located conductors 49 and the shield layer 61 at the said one discrete location along the length "T" of the cable 45. Any of a variety of suitable shield materials could be utilized for the metallic core shield layer 61 with a suitable metal tape being preferred. Although a copper foil tape was utilized in the example, other ferromagnetic materials, nickel, iron, nickel-iron alloys, silicon-iron alloys, cobalt-iron alloys, steel and the like could be utilized as well. In the embodiment of FIG. 3*a*, the metallic core shield layer 61 is also surrounded by a flexible outer jacket 63 such as a rubber shrink tubing.

In order to install the improved resistive-inductive core element of the invention, a portion of the original cable metallic braided shield layer 51 and outer jacket 53 are first removed. The removal of a portion of the cable metallic shield layer and outer jacket leaves oppositely exposed shield ends 67, 69 which are folded back over the top of the outer jacket 53, whereby the ends 67, 69 are spaced apart along the longitudinal axis 47 of the cable. The lumped ferrite toroid 55 is installed over the exposed conductor bundle 49 by either sliding the central opening 57 over the conductors if the cable end connectors have not yet been installed, or by providing the toroid 55 in two halves which are assembled about the conductor bundle with the conductors passing through the central opening 57, as shown in FIG. 3*a*.

While maintaining the position of the ferrite core 55, the encapsulating layer 59 is then applied. This can be accomplished by applying a suitable adhesive or curable potting material such as the previously mentioned "JET MELT" so that the material covers the ferrite core 55 and also overlaps the cable jacket in both directions. The two ends 67, 69 of the cable shield are folded back over the respective jacket ends so that they are left at least partly exposed past the applied encapsulant. The encapsulating layer is either cured or allowed to set according to the manufacturer's recommendations. The encapsulating layer 59 is then wrapped with copper tape 61, thereby forming the core metallic shield layer. The original cable braided shield ends 67, 69 which are exposed past the applied encapsulant are then folded back over the copper tape 61 on both ends and are soldered to form a 360° connection. The entire assembly can then be covered with, for example, a suitable rubber shrink tubing to form the outer jacket 63 for added protection. The solder regions 71, 73 form an electrical joint which connects the metallic core shield layer 61 with the oppositely exposed shield ends 67, 69 of the original cable 45, whereby the lumped ferrite toroid 55 is located between the centrally located conductors 49 and the metallic shield layer 61 at one discrete location along the longitudinal axis 47 of the cable 45.

An invention has been provided with several advantages. The improved electrical signal cable of the invention is capable of reducing common mode emissions, thereby allowing manufacturer's equipment to pass current emission standards. The resistive-inductive core element of the invention is simple in design and economical to manufacture. The improved core element is an inexpensive device to apply externally to but near a computer on an after market computer cable in order to allow a manufacturer to meet minimum common mode emission levels required by law in many countries. The lumped ferrite core used in the present invention provides a higher reflection of common mode emissions of low frequencies, typically less than 100 MHz. The invention can be easily applied to standard shielded cables. The improved electrical signal cables of the invention can be used in any digital system in order to lower common mode emissions to meet emissions requirements.

While the invention has been particularly shown and described with reference to a preferred embodiment, it will be understood by those skilled in the art that various changes in form and detail may be made therein without departing from the spirit and scope of the invention.

What is claimed is:

1. An improved electrical signal cable having a length and a longitudinal axis, the improved cable comprising:

at least one centrally located conductor running along the longitudinal axis of the cable;

a shield layer surrounding the centrally located conductor;

a core element of resistive-inductive material having a central opening therein, the core element being mounted about the centrally located conductor at one discrete location along the length of the cable with the cable shield layer being partly removed to leave oppositely exposed shield ends with the centrally located conductor passing through the central opening in the core element;

an encapsulating layer surrounding the core element;

a metallic core shield layer surrounding the encapsulating layer; and an electrical joint connecting the metallic core shield layer with the oppositely exposed shield ends of the cable shield layer, whereby the metallic core shield layer and the cable shield layer form a continuous layer running along the longitudinal axis of the cable.

2. The improved electrical signal cable of claim 1, wherein the resistive-inductive material is lumped ferrite.

3. An improved multiconductor signal cable having a length and a longitudinal axis, the improved cable comprising:

a plurality of centrally located conductors running along the longitudinal axis of the cable;

a metallic shield layer surrounding the plurality of centrally located conductors;

a lumped ferrite toroid having a central opening therein mounted about the plurality of centrally located conductors at one discrete location along the length of the cable when the cable metallic shield layer is partly removed to leave oppositely exposed shield ends, the lumped ferrite toroid being mounted about the plurality of centrally located conductors with the centrally located conductors passing through the central opening in the lumped ferrite toroid;

an encapsulating layer surrounding the ferrite toroid beneath the metallic shield layer;

a metallic core shield layer surrounding the encapsulating layer; and an electrical joint connecting the metallic core shield layer with the oppositely exposed shield ends of the cable metallic shield layer, whereby the metallic core shield layer and the cable metallic shield layer form a continuous layer running along the longitudinal axis of the cable.

4. The improved multiconductor signal cable of claim 3, wherein the encapsulating layer is a plastic molding compound.

5. The improved multiconductor signal cable of claim 4, further comprising:

a flexible outer jacket surrounding the metallic shield layer.

6. The improved multiconductor signal cable of claim 5, wherein the metallic shield layer is a layer of metallic tape covering the encapsulating layer.

7. A resistive-inductive core unit for use on a multiconductor signal cable to reduce common mode emissions, the cable having a length and a longitudinal axis and having a plurality of centrally located conductors surrounded by a metallic shield layer, the core unit comprising:

a lumped ferrite toroid having a central opening therein for receiving the plurality of centrally located conductors of the multiconductor signal cable at one discrete location along the length of the cable;

an encapsulating layer surrounding the lumped ferrite toroid when the toroid is installed on the centrally located conductors;

the lumped ferrite toroid being mountable about the plurality of centrally located conductors with the centrally located conductors passing through the central opening in the lumped ferrite toroid when the cable metallic shield layer is partly removed to leave oppositely exposed shield ends which are spaced apart along the longitudinal axis of the cable;

a metallic core shield layer surrounding the encapsulating layer; and an electrical joint connecting the metallic core shield layer with the oppositely exposed shield ends of the cable metallic shield layer when the toroid is in place on the cable, whereby the lumped ferrite toroid is located between the centrally located conductors and the metallic core shield layer at said one discrete location along the longitudinal axis of the cable and the metallic core shield layer and the cable metallic shield layer form a continuous layer running along the longitudinal axis of the cable.

8. The resistive inductive core element of claim 7, wherein the metallic core shield layer comprises a layer of metal tape wound about the lumped ferrite toroid, and wherein the electrical joint which connects the metallic core shield layer to the oppositely exposed cable metallic shield ends is comprised of a pair of solder joints joining the cable metallic shield ends and the core metal tape.

9. The resistive-inductive core element of claim 8, further comprising:

a flexible outer jacket surrounding the metallic core shield layer.

10. A digital system, comprising:

a central station housing;

at least one peripheral device;

a cable having a length and a central longitudinal axis electrically interconnecting the central station housing and the peripheral device, the cable comprising:

at least one centrally located conductor running along the longitudinal axis of the cable;

a shield layer surrounding the centrally located conductor; and a core element of resistive-inductive material having a central opening therein, the core element being mounted about the centrally located conductor at one discrete location along the length of the cable when the cable shield layer is partly removed to leave oppositely exposed shield ends with the centrally located conductor passing through the central opening in the core element;

an encapsulating layer surrounding the core element;

a metallic core shield layer surrounding the encapsulating layer; and an electrical joint connecting the metallic core shield layer with the oppositely exposed shield ends of the cable shield layer, whereby the metallic core shield layer and the cable shield layer form a continuous layer running along the longitudinal axis of the cable.

11. The digital system of claim 10, wherein the central station housing is a computer housing and the peripheral device is a peripheral computer device.

12. The digital system of claim 11, wherein the resistive-inductive material is a lumped ferrite.

* * * * *